US007259359B2

(12) United States Patent
Davey et al.

(10) Patent No.: US 7,259,359 B2
(45) Date of Patent: Aug. 21, 2007

(54) AUTOMATED GLASS ENTRANCE DOOR ASSEMBLY FOR WALK-IN COOLERS

(75) Inventors: Jerry Davey, Bradenton, FL (US); Mark Smith, Sarasota, FL (US)

(73) Assignee: Commercial Refrigerator Door Company, Inc., Sarasota, FL (US)

( * ) Notice: Subject to any disclaimer, the term of this patent is extended or adjusted under 35 U.S.C. 154(b) by 0 days.

(21) Appl. No.: 11/153,159

(22) Filed: Jun. 15, 2005

(65) Prior Publication Data

US 2006/0283850 A1 Dec. 21, 2006

(51) Int. Cl.
*H05B 3/06* (2006.01)

(52) U.S. Cl. ..... 219/522; 219/218

(58) Field of Classification Search ..... 219/522, 219/218, 219, 543; 49/404–409, 276; 160/118, 160/188

See application file for complete search history.

(56) References Cited

U.S. PATENT DOCUMENTS 2,858,408 A * 10/1958 Barroero ..... 49/70
3,859,502 A * 1/1975 Heaney ..... 219/218
4,127,765 A * 11/1978 Heaney ..... 219/218
4,382,177 A * 5/1983 Heaney ..... 219/522
4,855,567 A * 8/1989 Mueller ..... 219/218
6,225,904 B1 5/2001 Jaffe et al. ..... 340/545.6
6,525,659 B2 2/2003 Jaffe et al. ..... 340/545.6

* cited by examiner

*Primary Examiner*—Philip H. Leung
*Assistant Examiner*—Vinod Patel
(74) *Attorney, Agent, or Firm*—Holland & Knight LLP

(57) ABSTRACT

An automated glass cooler entrance door assembly for an opening in a walk-in cooler comprising at least one fixed, stationary side door that defines a walkway about the opening for ingress and egress into the cooler, at least one opposing sliding door operatively suspended from a concealed drive mechanism above the opening to slide sideways from a closed position across the opening to close-off the cooler to and from an opened position overlapping the fixed stationary side door to allow customer ingress and egress to the cooler via the walkway through the opening and each of the doors comprising heated glass that is electrically connected to electrical power to heat the same.

10 Claims, 6 Drawing Sheets

AUTOMATED GLASS ENTRANCE DOOR ASSEMBLY FOR WALK-IN COOLERS

BACKGROUND OF THE INVENTION

1. Field of the Invention

This invention relates to automated glass cooler entrance doors. More particularly, this invention relates to walk-in commercial refrigeration coolers having entrance glass doors.

2. Description of the Background Art

Presently, display refrigerators and freezers are commonly used in retail stores such as grocery and convenience stores for refrigerating merchandise such as beverages behind glass doors allowing the discriminating shopper to view the merchandise while shopping. Once the selection is made, the shopper may then open the glass door, reach-in and remove the product from the refrigerator or freezer.

Another method to merchandise cold beverages allows the customer to walk into the cooler to make a product selection. Walk-in coolers require the doors to be full-view glass not only for customer appeal but also to allow store personnel to monitor the interior of the cooler to prevent shoplifting.

Hinged manual glass entrance doors that swing open are generally available throughout the industry. Manual swing doors are undesirable, however, because the customer is preferably carrying a large amount of product such as a case of beer and cannot conveniently open the doors to exit the cooler. Hence, it is now commonplace for walk-in coolers to be fitted with automatic sliding glass doors that automatically open and close as a customer approaches the doors from the outside during ingress and, conversely, to also automatically open and close during customer egress. For example, U.S. Pat. Nos. 6,525,659 and 6,225,904, the disclosures of which are incorporated by reference herein, teach the use of motion and presence sensors to sense the ingress or egress of a customer and to control the energization, acceleration and deceleration of the sliding doors during opening and closing.

It is well recognized that conventional storefront automated entrance doors cannot be used for cooler entrance doors because the temperature difference between the store and the cooler is so significant that condensation forms exteriorly on the doors and on the sliding glass door drive components located inside the header above the doors. Not only does condensation present an unsightly appearance to the customer, it also presents a safety hazard to customers as the condensation puddles on the floor and leads to premature failure of the internal drive mechanism.

More particularly, it is recognized that storefront automated entrance doors perform satisfactorily for store entrance because generally there is little temperature difference from one side of the door to the other. A double set of automated doors, including an airlock, may even be employed in northern climates. During winter months, the indoor relative humidity is relatively low, thereby reducing the amount of condensation and allowing the use of the automated doors. However, using a double set of automated entrance doors for a walk-in cooler requires too much valuable floor space and is cost prohibitive. Even if a double set of doors are used, condensation would nevertheless form on the doors and drive mechanism during higher relative humidity conditions in summer.

Therefore, it is an object of this invention to provide an improvement which overcomes the aforementioned inadequacies of the prior art devices and provides an improvement which is a significant contribution to the advancement of the commercial walk-in cooler art.

Another object of the invention is to provide a way to employ automated doors for walk-in coolers in such a manner that condensation on the doors and drive mechanism is minimized.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing the invention, the invention comprises automated glass cooler entrance doors in which the temperature of all exterior surfaces is maintained above the ambient dew point at all times to prevent the formation of condensation. The doors incorporate multiple panes of glass and multiple frame materials with air pockets to insure that the door surfaces remain above the dew point. Furthermore, the glass may be heated and auxiliary heat in the form of heater wires are employed in the door jambs and frames areas prone to condensation to provide a thermal barrier to maintain proper surface temperatures. Seals are incorporated at the sliding joints to prevent convective heat loss and subsequent condensation formation.

The automated glass cooler entrance door assembly of the invention prevents condensation by raising the temperature of the exterior surfaces on the room side of the assembly above the dew point of the ambient air. As such, condensation will not form on these surfaces and puddling of condensate on the floor is precluded, thereby minimizing liability for the store owner that might otherwise occur due to customer slips and falls. In addition, since condensation on the electrical operating mechanism is likewise precluded, other safety hazards and premature failure of the electrical components are minimized or eliminated altogether.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
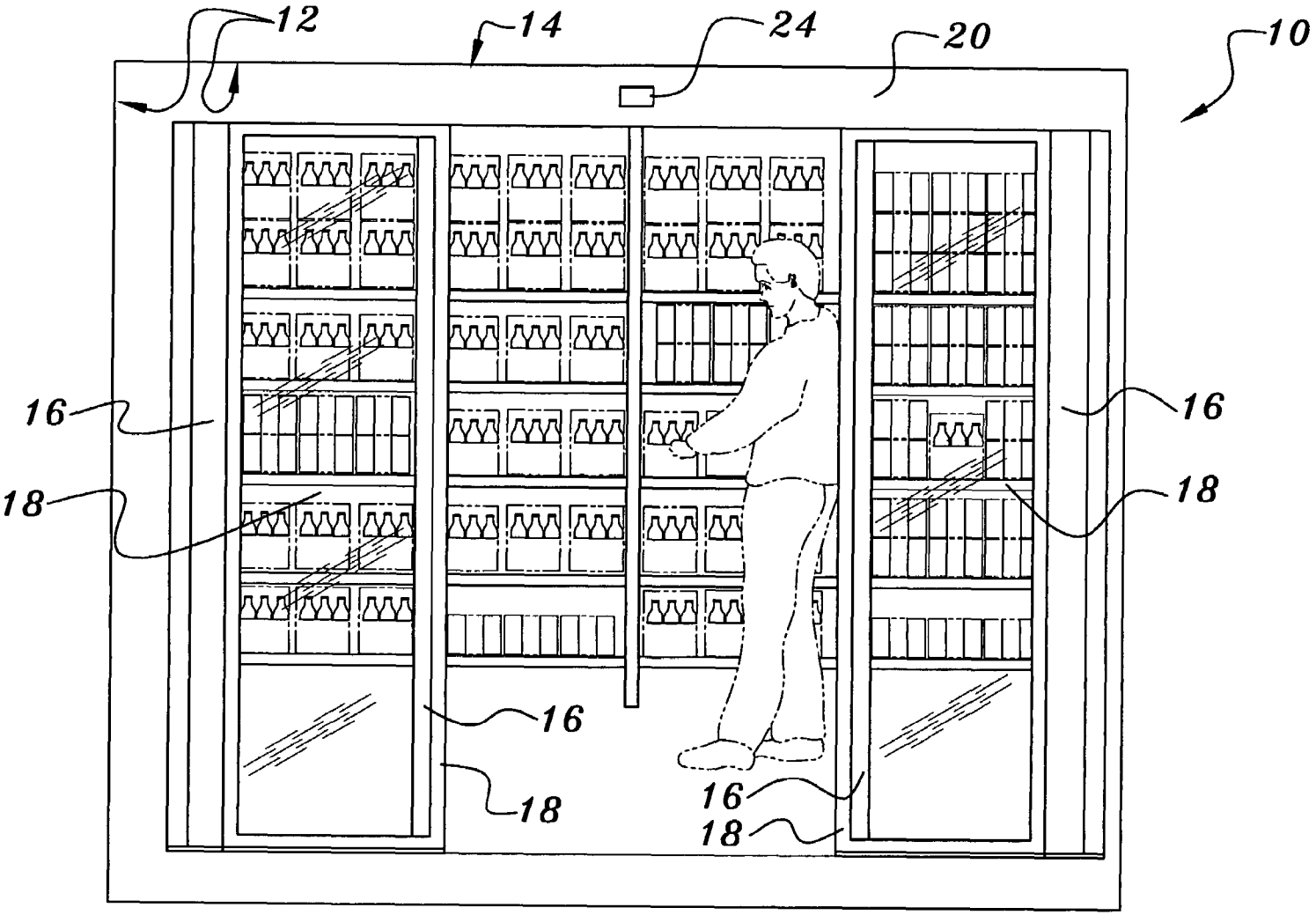
FIG. 1 is a general application for the automated glass cooler entrance doors assembly of the invention.
Figure 2:
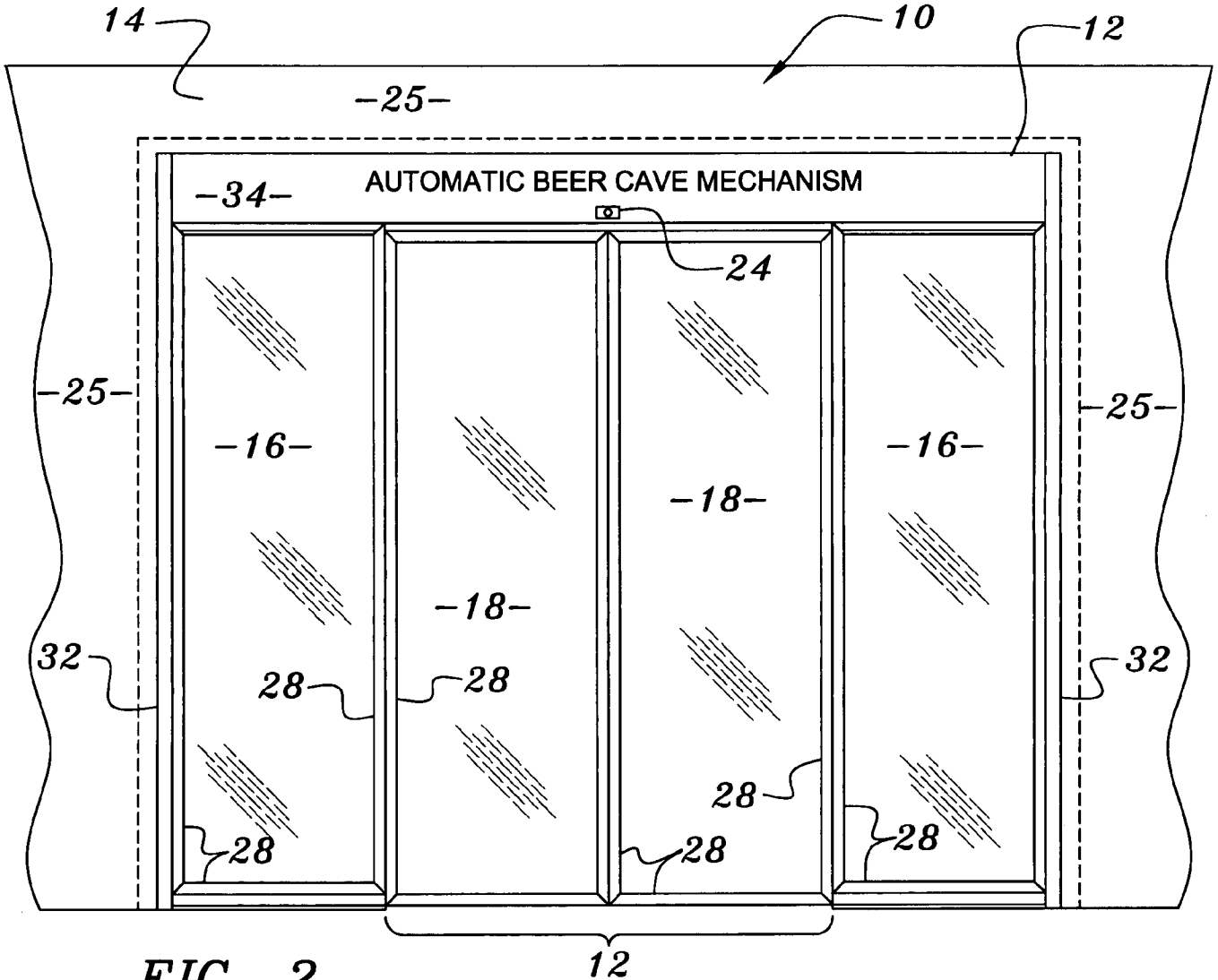
FIG. 2 illustrates a typical installation of the automated glass cooler entrance doors assembly of the invention employing two sliding glass doors and two fixed side glass doors for merchandise viewing.

Referring to FIGS. 1 and 2, the automated glass cooler entrance door assembly 10 of the invention in intended to be installed within an opening 12 of a refrigerated walk-in cooler 14 in a convenience store or other retail establishment in which refrigerated beverages or other refrigerated products are typically sold. The automated glass cooler entrance doors assembly 10 comprises a pair of fixed, stationary glass side doors 16 that define a walkway about the opening 12 for ingress and egress into the cooler 14. A pair of opposing sliding glass doors 18 are operatively suspended from a concealed drive mechanism 20 above the opening 12 to slide sideways to and from a closed position across the opening 12 to close-off the cooler 14 from the rest of the store and then to and from an opened position overlapping the respective fixed stationary side doors 16 to allow a customer 22 ingress and egress to the cooler via the walkway through the opening 12.

An electric eye 24 positioned exteriorly above the opening 12 senses the customer 22 who is approaching the sliding doors 18 about to enter the cooler 14 and triggers the actuation of the drive mechanism 20 to open the doors 18. Appropriate electronic circuitry then closes the doors 18 after the customer 22 has completed full ingress into the cooler 14. Conversely, another electric eye 24 positioned interiorly above the opening 12 senses the egress of the customer 22 to open the sliding doors 18 and to close the doors 18 once the customer has completed full egress through the opening 12.

In its preferred embodiment, the assembly 10 has a thickness substantially equal to the thickness of the walls 25 of the cooler 14 such that the entire assembly 10 will be substantially flush with the exterior and interior surfaces of the cooler wall 25.

Figure 3:
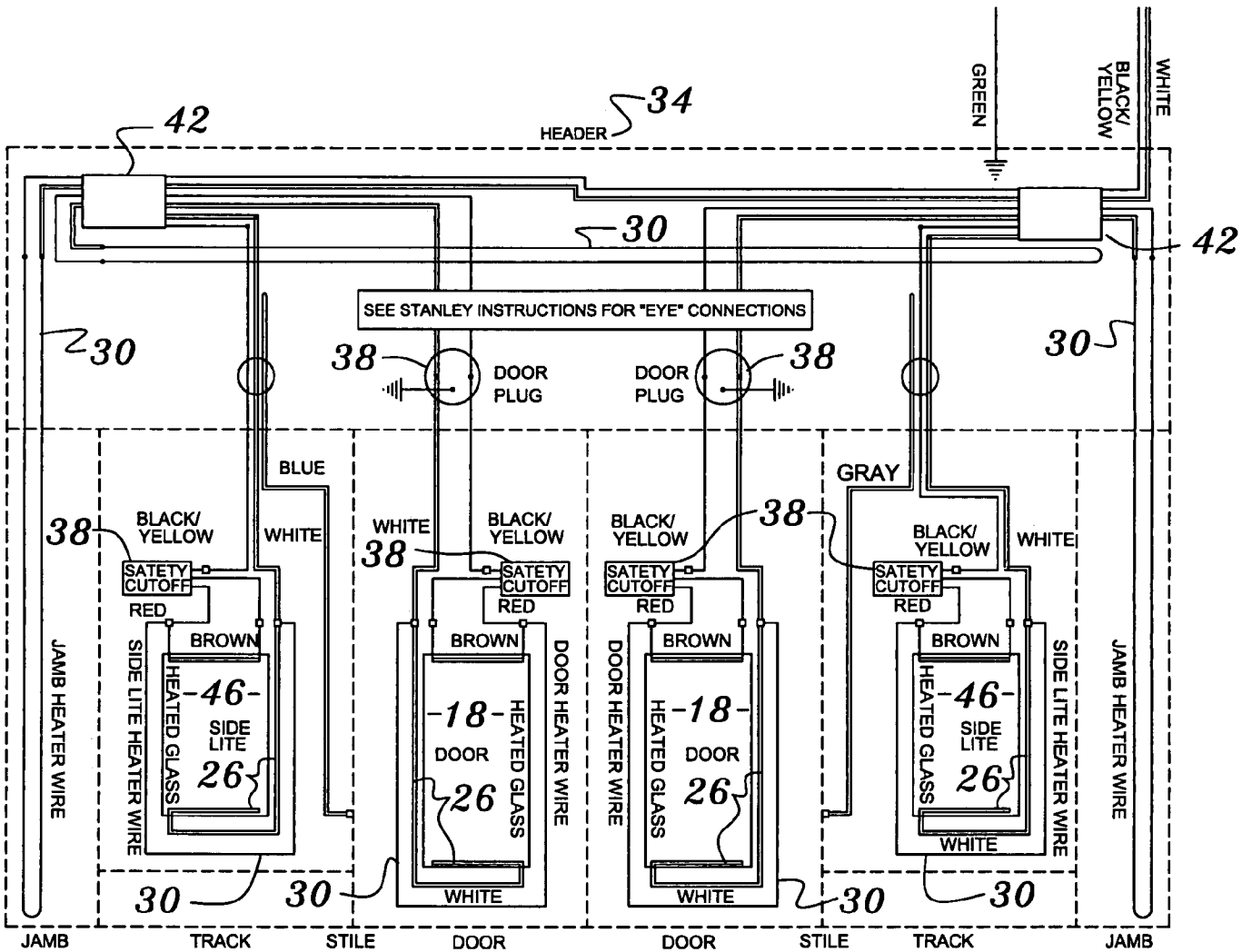
FIG. 3 is a wiring schematic for the heater wires for adding heat to the various surfaces.
Figure 4:
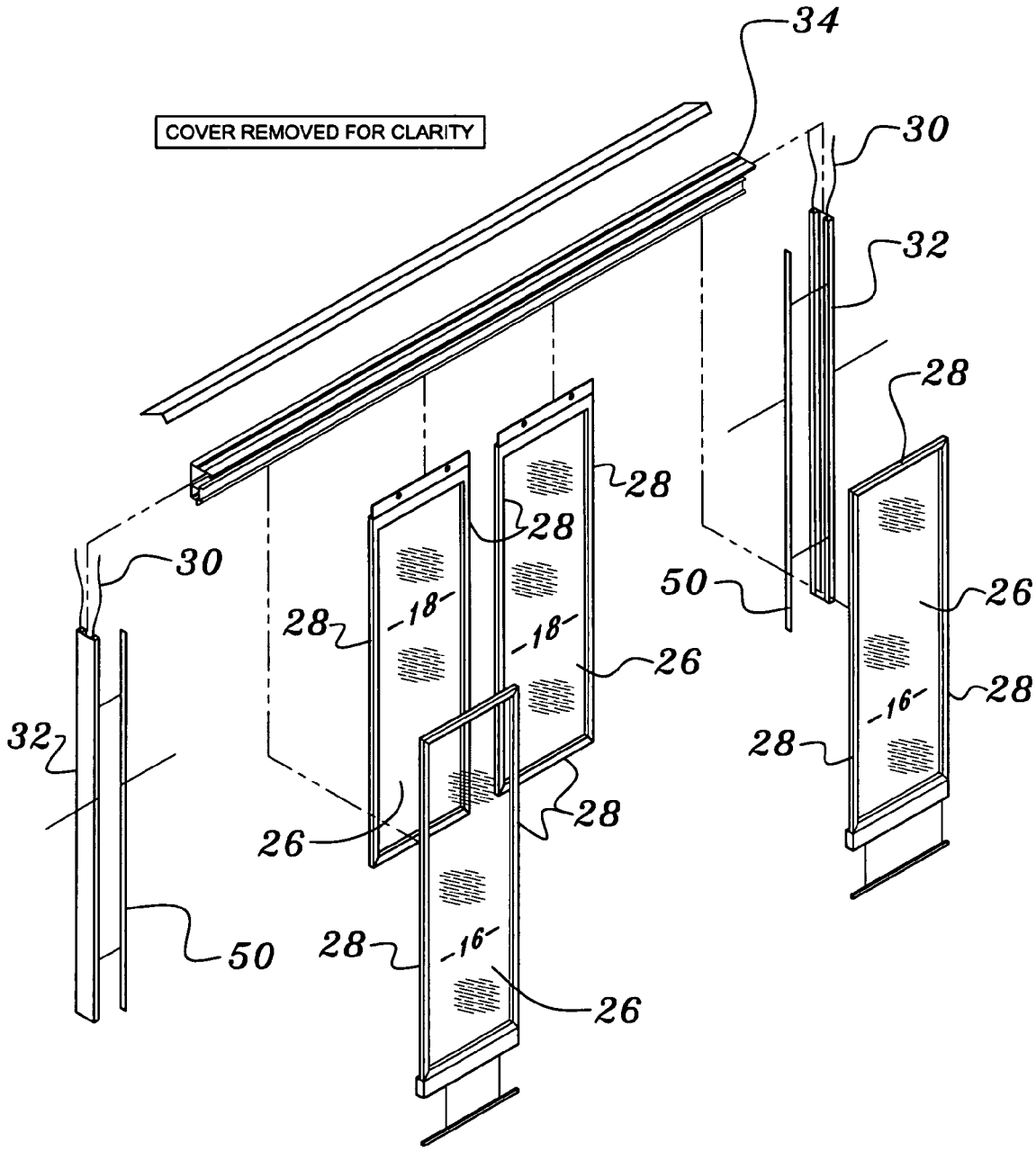
FIG. 4 is an exploded view of the automated glass cooler entrance doors assembly showing the two fixed and two slideable doors thereof.

Referring now to the schematic diagram of FIG. 3 and the exploded view of FIG. 4, each of the doors 16 & 18 comprises heated glass 26 that is electrically connected to electrically power to heat the same. Preferably, "surface 2" of the glass is heated. Surface 2 means in a two glass panel assembly, the inside surface of the outside glass panel. Additionally, the four door frames 28 (see FIG. 2) of each of the doors 16 & 18 include within their interior a heater wire 30 to heat the door frames 28. Similarly, both the left and right door jambs 32 of the fixed doors 16 are provided with heater wire 30 to heat the same. Finally, the header 34 containing the drive mechanism 20 is provided with heater wire 30 to heat the same.

The heated glass 26 and each of the heater wires 30 are electrically connected to one or more sources of electrical energy to supply a regulated amount of heat to the glass 26, frames 28, jambs 32 and header 34 to heat the same to be above the ambient temperature of the air, thereby preventing condensation on the glass doors 16 & 18, frames 28, jambs 32 and the header 34.

Figure 5:
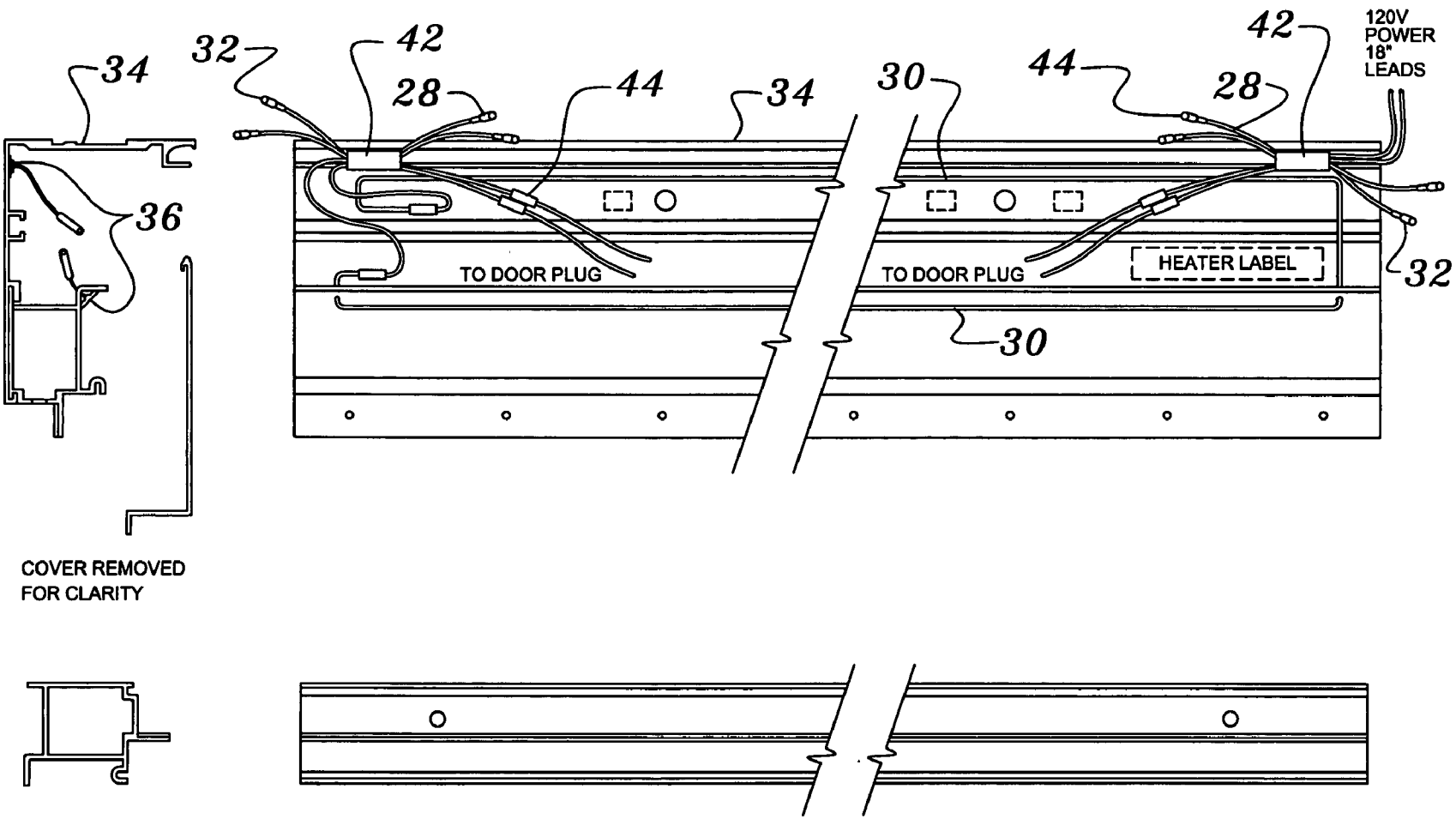
FIG. 5 is an electrical connection diagram showing the wiring layout for the heater wires.

Referring to FIG. 5 in combination with FIG. 4, it is seen that the wiring shown schematically in FIG. 3 to the heated glass 26 and to the heater wires 30, along with the heater wires 30 themselves, are preferably embedded into the extrusions forming the frames 28, jambs 32 and header 34. More preferably, the frames 28, jambs 32 and header 34 are formed hollow from a thermally conductive metal, such as by extruding aluminum, with appropriate channels formed along the inner surfaces thereof into which the heater wires 30 are then entrained to be held securing in place in direct thermal contact with the metal for good heat transfer. Alternatively, in some areas heat sink tape 36 may be used to hold the heater wire in thermal contact with the interior surfaces. Appropriate conventional plugs 38, safety cutoffs 38, terminal blocks 42 and connectors 44 may be provided for safety and ease in maintenance (see FIGS. 3 and 5).

Figure 6A:
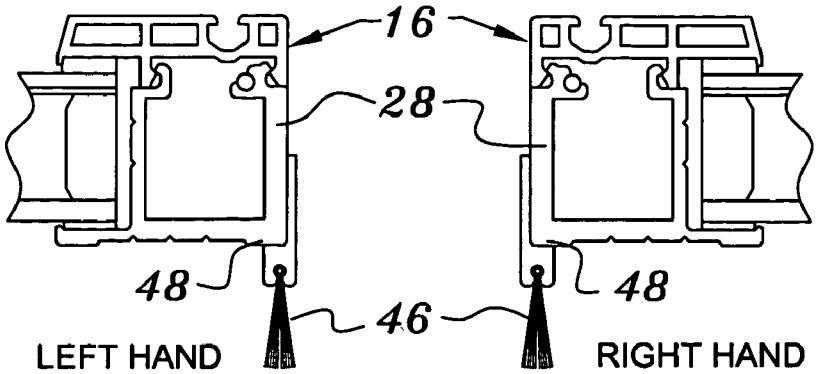
FIGS. 6A and 6B illustrate the sliding seals incorporated onto the doors to prevent convective heat transfer.
Figure 6B:
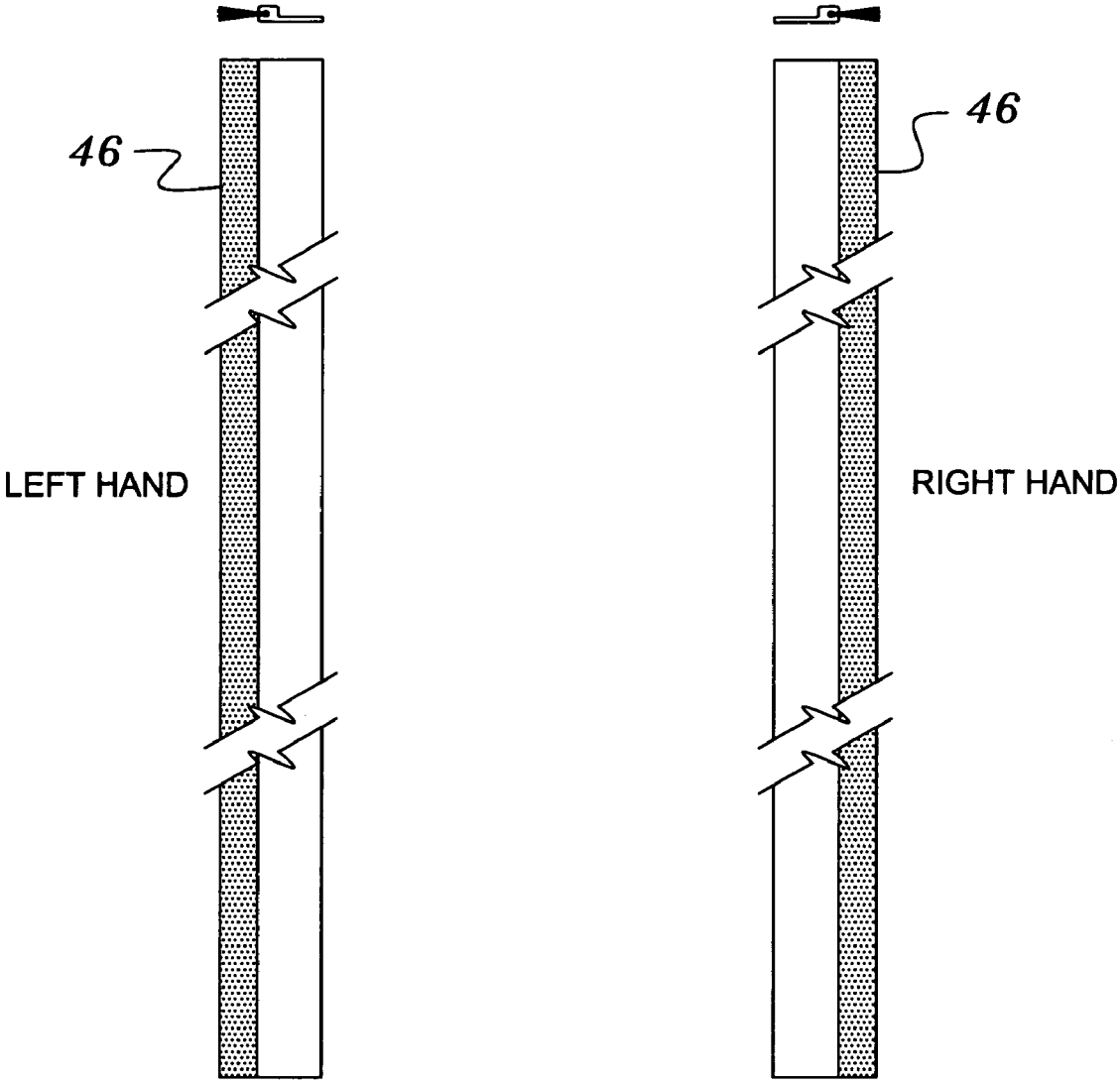

Referring now to FIGS. 6A and B, the invention comprises longitudinal brush seals 46 along the vertical edges 48 of the door frames 28 of the fixed doors 16 along the opening 12 that mate with the respective sliding glass doors 18. The brush seals 46 serve to form a thermal seal between the fixed and the sliding doors 16 & 18 yet allow the sliding doors 18 to freely slide when actuated.

It is noted that the normal desired temperature for a cooler 14 is 38° Fahrenheit and that a common temperature for a convenience store is 75° Fahrenheit. As shown in FIG. 4, under these operating conditions, the door frames and jambs 28 and 32 may be insulated with snap-on covers 50 formed of a non-thermally conductive material such as plastic. When covers 50 are used and the cooler is maintained at 38° Fahrenheit, the heater wires 30 in the door jambs and frames 28 and 32 may not be necessary. However, when the cooler 14 is maintained at 30° Fahrenheit (common for beer coolers), the heater wires 30 are necessary.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A walk-in cooler, comprising in combination:

an opening into the walk-in cooler, the opening being defined by left and right side edges, an upper edge and a floor;

an automated glass cooler entrance door assembly installed between said left and right side edges and between said upper edge and said floor; and said automated glass cooler entrance door assembly including at least one sliding door operatively suspended from a drive mechanism positioned within a generally hollow header affixed to an underside of said upper edge of said opening and at least one fixed stationary side door mounted within a generally hollow door frame and affixed to a generally hollow door jamb affixed to one of said side edges of said opening and wherein said sliding door may slide sideways from a closed position across said opening to close-off the cooler to and from an opened position overlapping the fixed stationary side door to allow customer ingress and egress to the cooler through the opening, said generally hollow header including a heater wire to heat the interior thereof and minimize condensation on said drive mechanism and the interior of said door frame and said door jamb including heater wires to heat the same and minimize condensation and said doors each comprise heated glass that is electrically connected to electrical power to heat the same and minimize condensation.

2. The walk-in cooler as set forth in claim 1, wherein the heated glass and each of the heater wires are electrically connected to one or more sources of electrical energy to supply a regulated amount of heat to the glass, frames, jambs and header to heat the same to be above the ambient temperature of the air, thereby preventing condensation on the glass doors, frames, jambs and the header.

3. The walk-in cooler as set forth in claim 1, wherein the frames, jambs and header are formed hollow from a thermally conductive metal with appropriate channels formed along the inner surfaces thereof into which the heater wires are then entrained to be held securing in place in direct thermal contact with the metal for good heat transfer.

4. The walk-in cooler as set forth in claim 1, wherein heat sink tape holds the heater wires in thermal contact with the interior surfaces.

5. The walk-in cooler as set forth in claim 1, further including an electric eye positioned exteriorly above the opening to sense a customer who is approaching the sliding doors about to enter the cooler and triggers the actuation of the drive mechanism to open the doors.

6. The walk-in cooler as set forth in claim 1, further including an electric eye positioned interiorly above the opening to sense the egress of the customer to open the sliding doors and to close the doors once the customer has completed full egress through the opening.

7. The walk-in cooler as set forth in claim 1, further including longitudinal brush seals along vertical edges of the door frames of the fixed doors along the opening that mate with the respective sliding glass doors to form a thermal seal between the fixed and the sliding doors yet allow the sliding doors to freely slide when actuated.

8. The walk-in cooler as set forth in claim 1, wherein the assembly is installed substantially flush with the exterior surface of the cooler.

9. The walk-in cooler as set forth in claim 1, wherein the assembly is installed substantially flush with the interior surface of the cooler.

10. The walk-in cooler as set forth in claim 1, wherein said heater wires are embedded into extrusions forming said frames, jambs and header.

* * * * *